US007540280B2

(12) United States Patent
Liao et al.

(10) Patent No.: US 7,540,280 B2
(45) Date of Patent: Jun. 2, 2009

(54) BULLET CARTRIDGE FOR TOY AIR GUN

(76) Inventors: Jhih-Wun Liao, P.O. Box 24-108, Taipei (TW); Yi-Sing Chen, P.O. Box 24-108, Taipei (TW)

( * ) Notice: Subject to any disclaimer, the term of this patent is extended or adjusted under 35 U.S.C. 154(b) by 68 days.

(21) Appl. No.: 11/805,302

(22) Filed: May 24, 2007

(65) Prior Publication Data

US 2008/0289613 A1 Nov. 27, 2008

(51) Int. Cl.
*F41B 11/00* (2006.01)

(52) U.S. Cl. ..... 124/74; 124/73

(58) Field of Classification Search ..... 124/73, 124/74, 76

See application file for complete search history.

(56) References Cited

U.S. PATENT DOCUMENTS 5,476,087 A * 12/1995 Kunimoto ..... 124/73
5,477,843 A * 12/1995 Kunimoto ..... 124/73
5,509,399 A * 4/1996 Poor ..... 124/76
5,664,552 A * 9/1997 Kunimoto ..... 124/73
5,711,286 A * 1/1998 Petrosyan et al. ..... 124/73
5,884,615 A * 3/1999 Casas Salva ..... 124/71
6,026,797 A * 2/2000 Maeda et al. ..... 124/74
6,073,620 A * 6/2000 Kunimoto ..... 124/74
6,112,734 A * 9/2000 Kunimoto ..... 124/73
6,158,424 A * 12/2000 Kunimoto ..... 124/73
6,470,872 B1 * 10/2002 Tiberius et al. ..... 124/74
6,497,229 B1 * 12/2002 Maeda ..... 124/76
7,237,543 B2 * 7/2007 Su ..... 124/71
7,273,047 B2 * 9/2007 Hu ..... 124/74
7,353,815 B2 * 4/2008 Wei ..... 124/45
7,415,977 B2 * 8/2008 Chen ..... 124/74

* cited by examiner

*Primary Examiner*—Troy Chambers
*Assistant Examiner*—Gabriel J Klein
(74) *Attorney, Agent, or Firm*—Troxell Law Office, PLLC

(57) ABSTRACT

A bullet cartridge for toy air gun (air soft gun BB-gun) in which a gasket member is mounted with a metal bush and stopped at an annular stop flange between a front air chamber and a rear air chamber to support a reciprocating motion of a piston rod, and a compression spring is mounted on the piston rod and stopped between the metal bush and a collar of the piston rod to hold the piston rod in the close position where the front stop flange of the piston rod is stopped at the front side of the gasket member to seal the air passage between the $CO_2$ steel cylinder and the jet nozzle through which compressed gas passes to drive a bullet out of the toy air gun.

2 Claims, 7 Drawing Sheets

BULLET CARTRIDGE FOR TOY AIR GUN

BACKGROUND OF THE INVENTION

1. Field of the Invention

The present invention relates to a toy air gun (air soft gun/BB-gun) and more particularly, to a bullet cartridge for toy air gun (air soft gun/BB-gun) that requires less pressure to strike the hammer against the piston rod and that causes less noise when striking the hammer against the piston rod to fire a bullet.

2. Description of the Related Art

Using a toy air gun or the so-called air soft gun/BB-gun to play a shooting game is an outdoor activity widely invited by students and office people. A toy air gun uses a compressed gas to drive a soft bullet out of the gun toward the target. A toy air gun generally comprises a bullet cartridge 1' (see FIGS. 1 and 2), which comprises a bullet supplier unit 2' and a compressed gas supplier unit 3'. When the user triggered the trigger, a hammer is driven to strike a piston rod 48', thereby opening the air passage for enabling a compressed gas to go out of the compressed gas supplier unit 3' through a jet nozzle to drive a soft bullet out of the gun barrel of the toy air gun. According to this design, the piston at the piston rod bears a big pressure from the compressed gas, therefore a high pressure is necessary to strike the hammer against the piston rod, and a high noise will be produced when striking the hammer against the piston rod.

FIG. 3 shows another structure of bullet cartridge for toy air gun according to the prior art. According to this design, bullet cartridge 1' comprises a bullet supplier unit 2' and a compressed gas supplier unit 3'. The compressed gas supplier unit 3' uses a $CO_2$ steel cylinder 5' to supply a compressed gas for firing bullets. However, because the pressure of the compressed gas of the $CO_2$ steel cylinder 5' is very high, the striking force of the hammer is insufficient to overcome the pressure of the compressed gas of the $CO_2$ steel cylinder 5', and therefore a pressure reducing valve 7' must be used to reduce the pressure of the compressed gas of the $CO_2$ steel cylinder 5'. The use of the pressure reducing valve 7' complicates the structure of the bullet cartridge 1', and relatively increases the manufacturing cost of the bullet cartridge 1'.

SUMMARY OF THE INVENTION

The present invention has been accomplished under the circumstances in view. It is the main object of the present invention to provide a bullet cartridge for toy air gun (air soft gun/BB-gun), which requires less pressure to strike the hammer against the piston rod, and causes less noise when striking the hammer against the piston rod to fire a bullet.

To achieve this and other objects of the present invention, the bullet cartridge for toy air gun (air soft gun/BB-gun) comprises an air chamber transversely disposed near a top side thereof, an annular stop flange disposed inside the air chamber and dividing the air chamber into a front chamber and a rear chamber, a jet nozzle perpendicularly extending from the front chamber for guiding out a compressed gas to fire a bullet, metal bush mounted with a gasket member and stopped at the annular stop flange inside the rear chamber, the gasket member having a front wall stopped against the annular stop flange a screw cap fastened to a rear end of the rear chamber remote from the front chamber, the screw cap having a center through hole, a piston rod inserted through the metal bush and the center through hole of the gasket member and the center through hole of the screw cap, the piston rod having a front stop flange suspending in the front chamber for stopping the front wall of the gasket member to seal the center through hole of the gasket member and a collar extending around the periphery and suspending in the rear chamber, a compression spring sleeved onto the piston rod and stopped between the collar of the piston rod and the metal bush to force the metal bush and the gasket member against the annular stop flange and to support the piston rod in the position where the front stop flange of the piston rod is stopped at the front wall of the gasket member to seal the center through hole of the gasket member and to isolate the front chamber from the rear chamber, and an air inlet passage for guiding a compressed gas from a $CO_2$ steel cylinder into the rear chamber.

DETAILED DESCRIPTION OF THE PREFERRED EMBODIMENT

Figure 1:
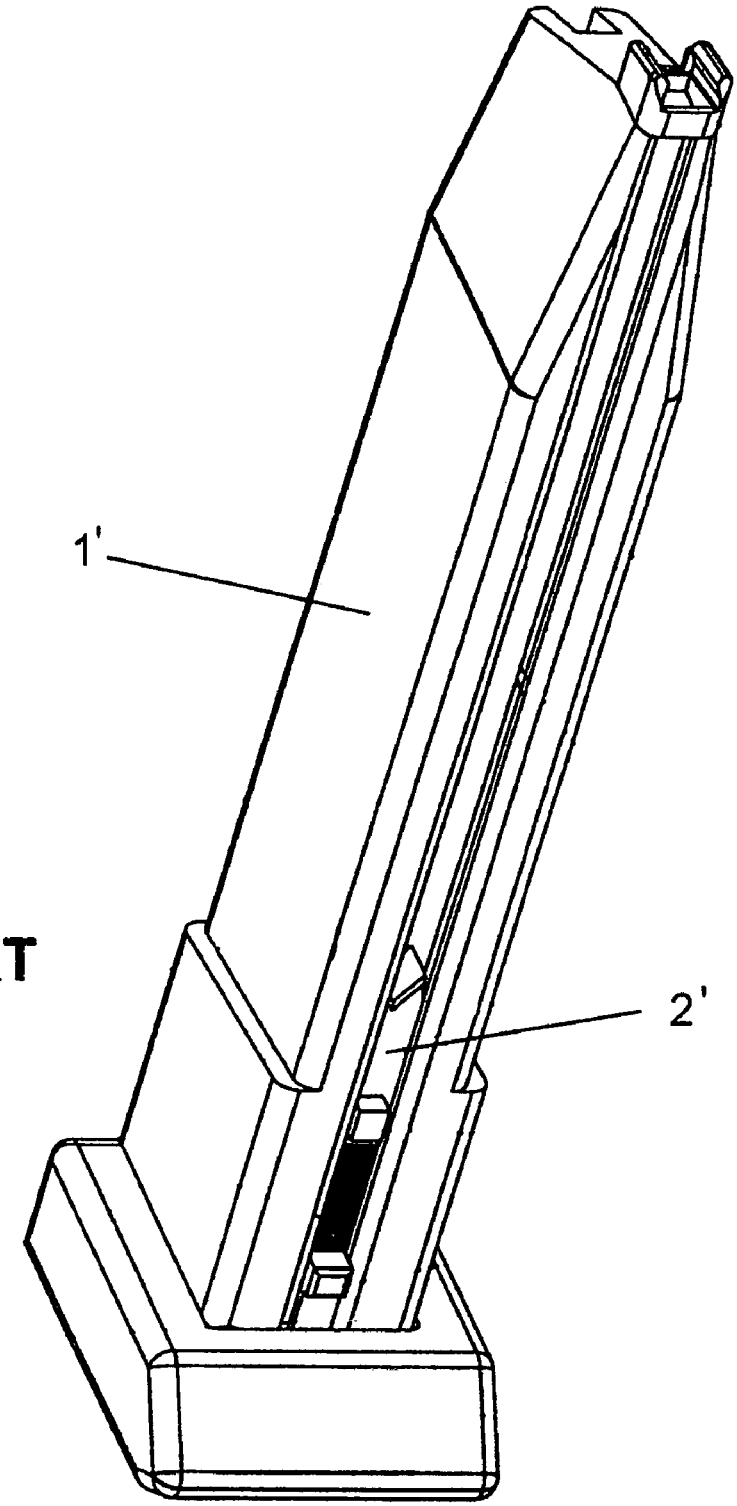
FIG.1 PRIOR ART
FIG. 1 is an elevational view of a bullet cartridge for toy air gun (air soft gun/BB-gun) according to the prior art.
Figure 2:
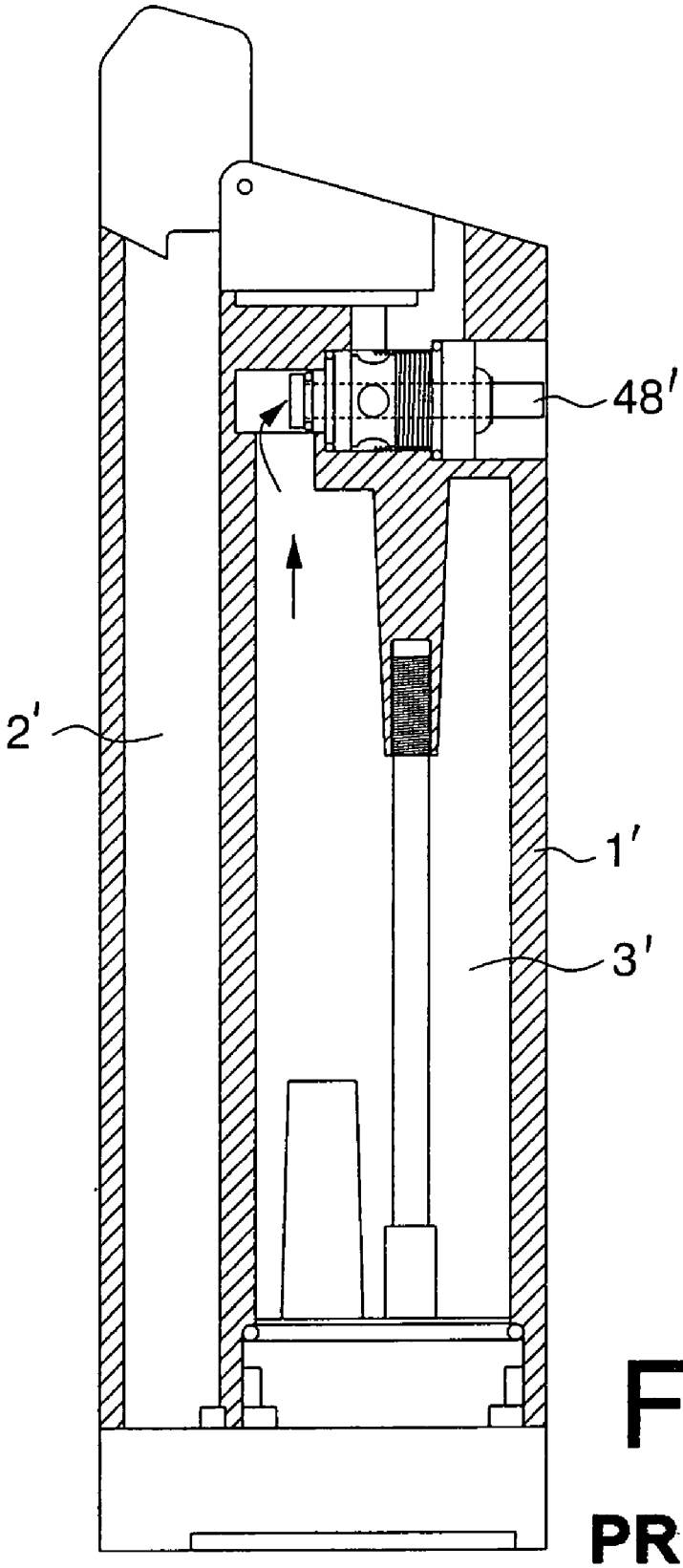
FIG.2 PRIOR ART
FIG. 2 is a side view in section of the bullet cartridge shown in FIG. 1.
Figure 3:
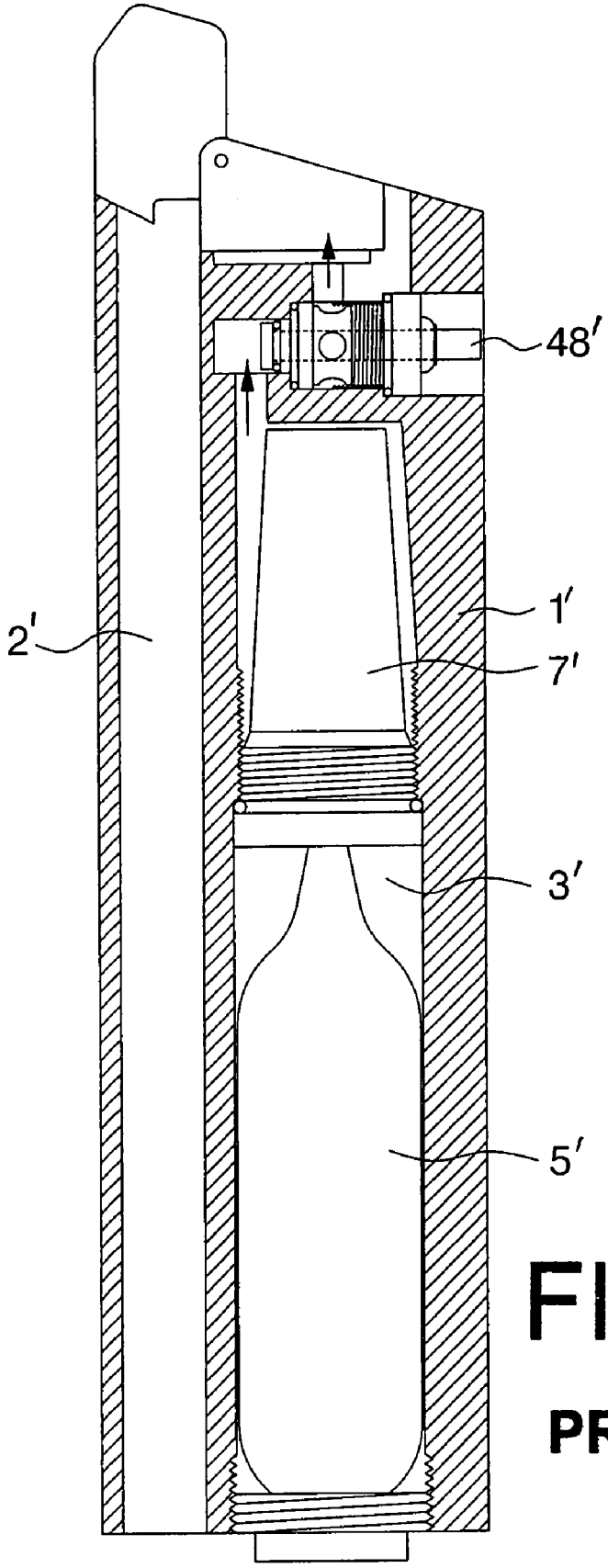
FIG.3 PRIOR ART
FIG. 3 is a sectional view of another structure of bullet cartridge for toy air gun (air soft gun/BB-gun) according to the prior art.
Figure 4:
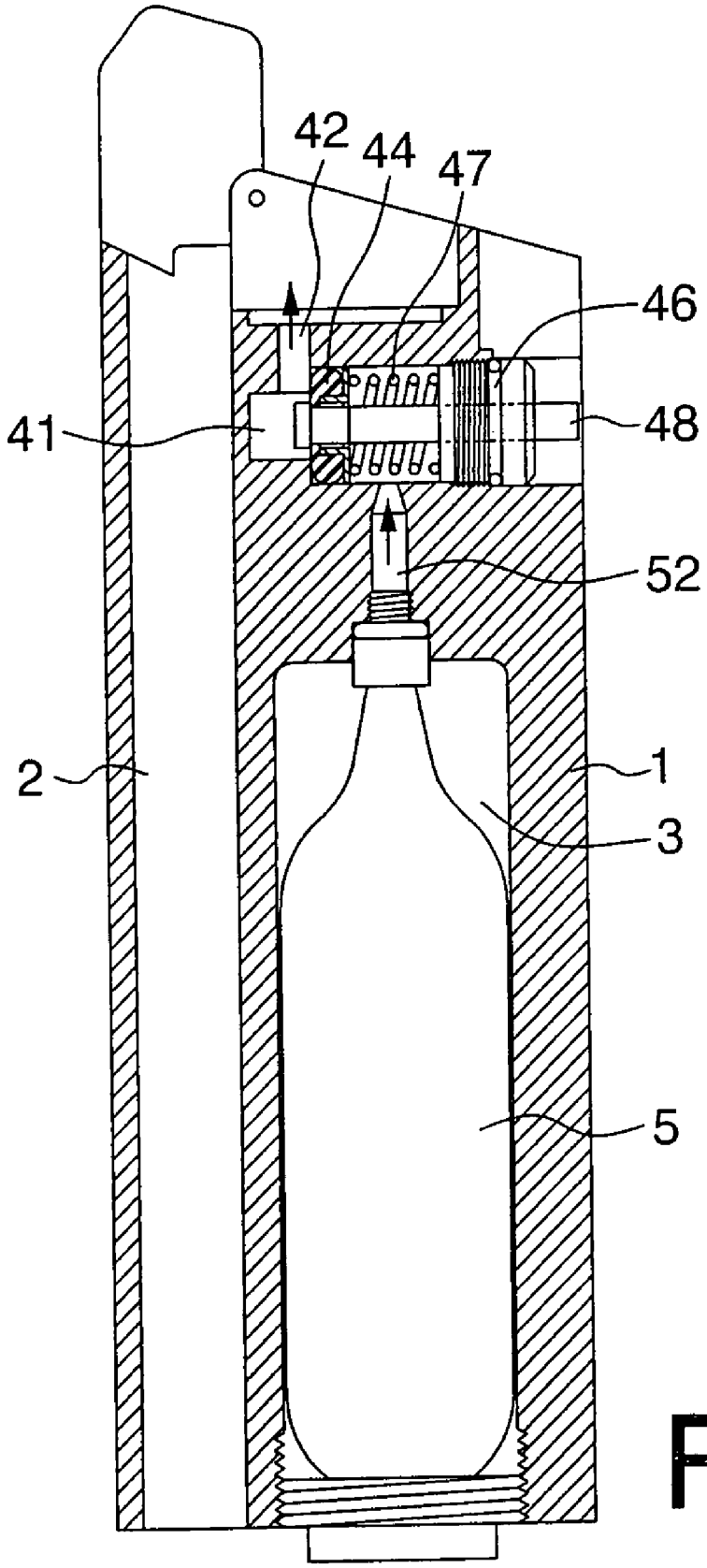
FIG. 4 is a sectional side view of a bullet cartridge for toy air gun (air soft gun/BB-gun) in accordance with the present invention.
Figure 5:
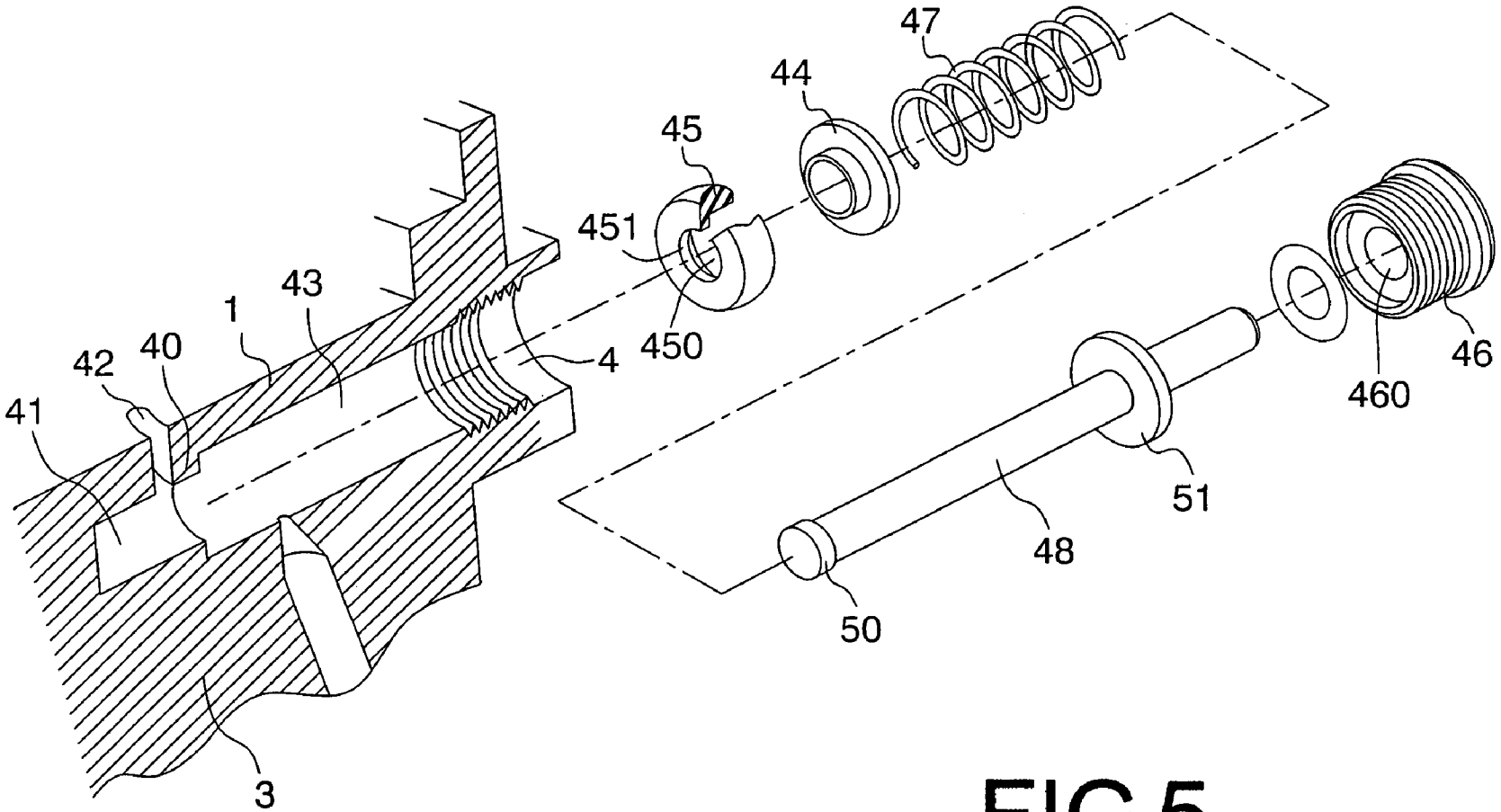
FIG. 5 is an exploded view of the bullet cartridge for toy air gun (air soft gun/BB-gun) according to the present invention.
Figure 6:
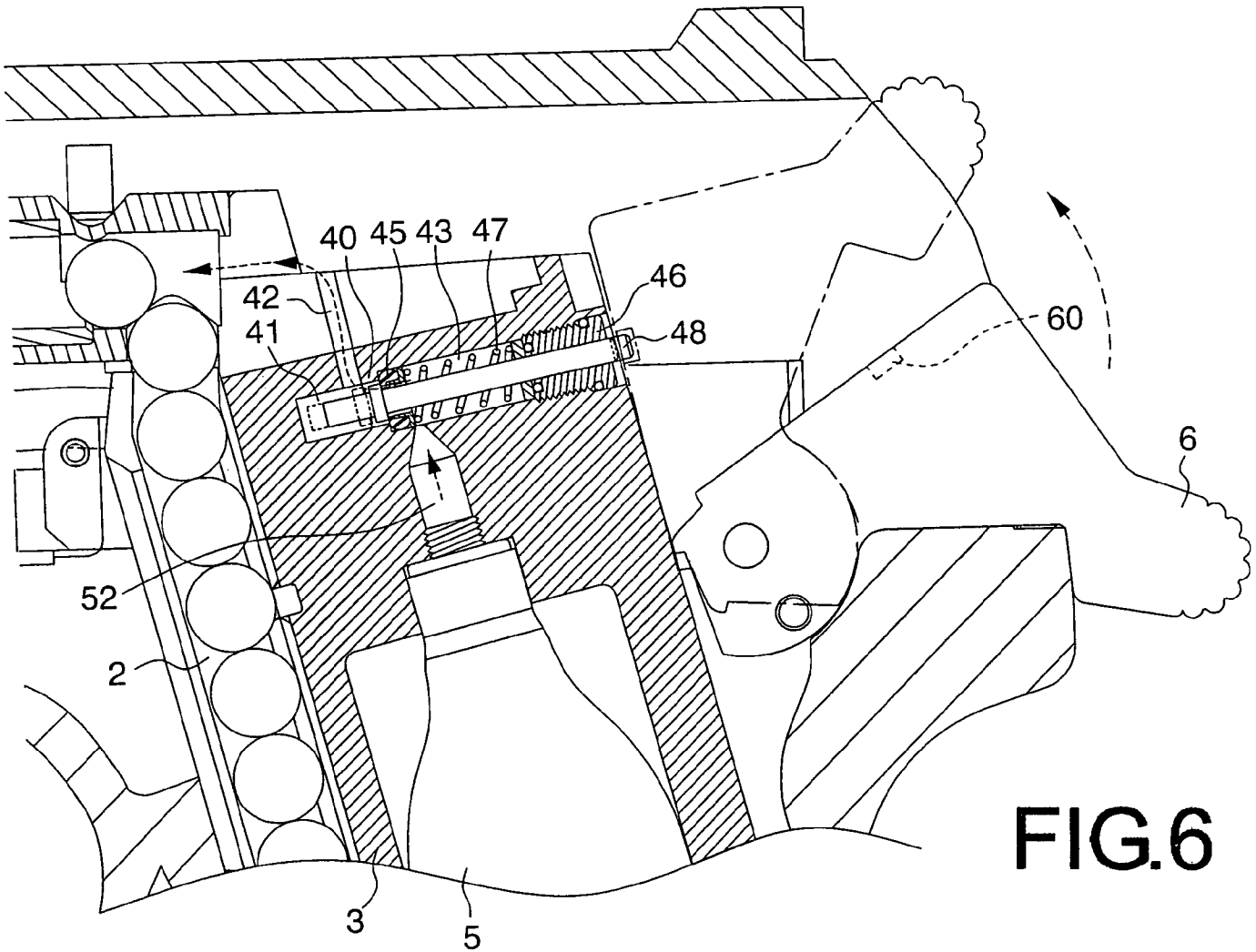
FIG. 6 is a sectional view of a part of the present invention, showing the bullet cartridge in action.

Referring to FIGS. 4~6, a bullet cartridge 1 for use in a toy air gun (air soft gun/BB-gun) in accordance with the present invention is shown comprising a bullet supplier unit 2 and a compressed gas supplier unit 3. The compressed gas supplier unit 3 comprises an air chamber 4 transversely disposed near the top side of the bullet cartridge 1, an annular stop flange 40 disposed inside the air chamber 4 and dividing the air chamber 4 into a front chamber 41 and a rear chamber 43, a jet nozzle 42 perpendicularly extending from the front chamber 41 for guiding out a compressed gas to fire a bullet, a metal bush 44 mounted with a gasket member 45 and stopped at the annular stop flange 40 inside the rear chamber 43 to support a piston rod 48. The gasket member 45 has a front wall 451 and a center through hole 450 cut through the center of the front wall 451 for the passing of the piston rod 48. The piston rod 48 has front stop flange 50 disposed at the front end and suspending in the front chamber 41, and a collar 51 extending around the periphery near the rear end and suspending in the rear chamber 43. The front stop flange 50 has a diameter greater than the center through hole 450 of the gasket member 45. The compressed gas supplier unit 3 further comprises a screw cap 46 fastened to the rear end of the rear chamber 43 remote from the front chamber 41 to support the rear end of the piston rod 48, and a compression spring 47 sleeved onto the piston rod 48 and stopped between the collar 51 of the piston rod 48 and the metal bush 44. The screw cap 46 has a center through hole 460 for the passing of the rear end of the piston rod 48. Normally, the spring power of the compression spring 47 holds the piston rod 48 in such a position that the front stop flange 50 is stopped at the front wall 451 of the gasket member 45 to seal the center through hole 450, thereby blocking the air passage between the front chamber 41 and the rear chamber 43. The compressed gas supplier unit 3 further comprises a $CO_2$ steel cylinder 5 mounted in the bullet cartridge 1 below the air chamber 4, and an air passage 52 in communication between (the output port of) the $CO_2$ steel cylinder 5 and the rear chamber 43.

Figure 7:
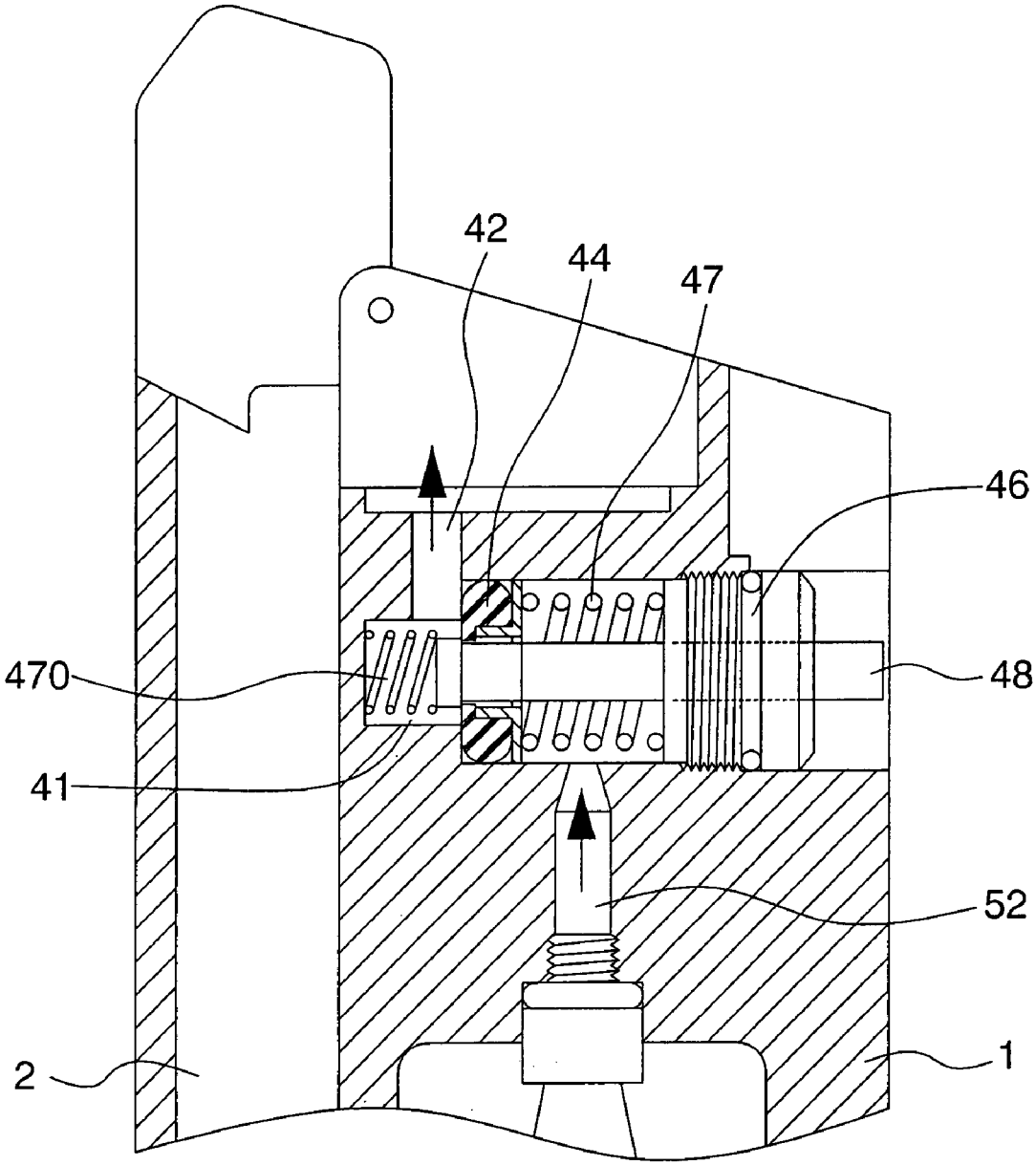
FIG. 7 is a sectional view of an alternate form of the bullet cartridge for toy air gun (air soft gun/BB-gun) according to the present invention.

Referring to FIG. 7, a supplementary compression spring 470 may be mounted in the front chamber 41 and stopped between the end wall of the front chamber 41 and the front stop flange 50 of the piston rod 48, forcing the front stop flange 50 of the piston rod 48 toward the gasket member 45.

Referring to FIGS. 4~7 again, when triggered the trigger (not shown) to strike the hammer 6 against the rear end of the piston rod 48, the piston rod 48 is forced forwards in a rush to open the center through hole 450 of the gasket member 45 and simultaneously to compress the compression springs 47 and 470 for enabling compressed gas to go from the rear chamber 43 through the center through hole 450 into the front chamber 41 and then the jet nozzle 42 to drive the bullet out of the toy air gun. Immediately after firing of the bullet, the spring power of the compression springs 47 and 470 forces the piston rod 48 backwards to its former position where the rear end of the piston rod 48 is engaged into a hole 60 on the hammer 6 and the front stop flange 50 seals the center through hole 450 of the gasket member 45. Because the collar 51 of the piston rod 48 has a limited area and is not used to move the compressed gas, it does not receive much air pressure. Therefore, the hammer 6 can be driven to strike the piston rod 48 with less pressure, and striking the hammer 6 against the piston rod 48 does not cause a loud noise. When firing a bullet, the user can hold the toy air gun steadily in hand. The design of the present invention needs no the user of a pressure reducing valve or to increase the length of the bullet cartridge, and allows for the installation of a high pressure $CO_2$ steel cylinder 5.

A prototype of bullet cartridge for toy air gun has been constructed with the features of FIGS. 4~7. The bullet cartridge for toy air gun functions smoothly to provide all of the features discussed earlier.

Although particular embodiments of the invention have been described in detail for purposes of illustration, various modifications and enhancements may be made without departing from the spirit and scope of the invention.

What the invention claimed is:

1. A bullet cartridge for toy air gun comprising an air chamber transversely disposed near a top side thereof, an annular stop flange disposed inside said air chamber and dividing said air chamber into a front chamber and a rear chamber, a jet nozzle perpendicularly extending from said front chamber for guiding out a compressed gas to fire a bullet, a metal bush mounted with a gasket member and stopped at said annular stop flange inside the rear chamber, said gasket member having a front wall stopped against said annular stop flange, a screw cap fastened to a rear end of said rear chamber remote from said front chamber, said screw cap having a center through hole, a piston rod inserted through said metal bush and a center through hole of said gasket member and the center through hole of said screw cap, said piston rod having a front stop flange suspending in said front chamber for stopping said front wall of said gasket member to seal the center through hole of said gasket member and a collar extending around the periphery and suspending in said rear chamber, a compression spring sleeved onto said piston rod and stopped between said collar of said piston rod and said metal bush to force said metal bush and said gasket member against said annular stop flange and to support said piston rod in the position where the front stop flange of said piston rod is stopped at the front wall of said gasket member to seal the center through hole of said gasket member and to isolate said front chamber from said rear chamber, and an air inlet passage for guiding a compressed gas from a $CO_2$ steel cylinder into said rear chamber.

2. The bullet cartridge for toy air gun as claimed in claim 1, further comprising a supplementary compression spring mounted in said front chamber and stopped between an end wall of said front chamber and the front stop flange of said piston rod to force the front stop flange of said piston rod against the front wall of said gasket member.

* * * * *